United States Patent [19]

Bahler et al.

[11] Patent Number: 4,896,358

[45] Date of Patent: Jan. 23, 1990

[54] METHOD AND APPARATUS OF REJECTING FALSE HYPOTHESES IN AUTOMATIC SPEECH RECOGNIZER SYSTEMS

[75] Inventors: Lawrence G. Bahler; Alan L. Higgins, both of San Diego, Calif.

[73] Assignee: ITT Corporation, New York, N.Y.

[21] Appl. No.: 26,585

[22] Filed: Mar. 17, 1987

[51] Int. Cl.[4] ..... G10L 7/08

[52] U.S. Cl. ..... 381/43; 381/41

[58] Field of Search ..... 381/41-50; 364/513.5

[56] References Cited

U.S. PATENT DOCUMENTS

| | | | |
|---|---|---|---|
| 4,081,607 | 3/1978 | Vitols et al. | 381/45 |
| 4,241,329 | 12/1980 | Bahler et al. | 381/45 |
| 4,481,593 | 11/1984 | Bahler | 364/513.5 |
| 4,624,010 | 11/1986 | Takebayashi | 381/43 |
| 4,625,287 | 11/1986 | Matsuura et al. | 364/513.5 |
| 4,713,777 | 12/1987 | Klovstad et al. | 364/513.5 |
| 4,713,778 | 12/1987 | Baker | 364/513.5 |
| 4,763,278 | 8/1988 | Rajasekaran et al. | 381/43 |

*Primary Examiner*—Gary V. Harkcom
*Assistant Examiner*—David D. Knepper
*Attorney, Agent, or Firm*—Thomas N. Twomey; Mary C. Werner

[57] ABSTRACT

An automatic speech recognition system employs parallel syntaxes with a first syntax operative to compare keyword templates with incoming speech over a given time interval and with a second syntax in parallel with the first and operative to compare filler templates with incoming speech over the same interval. Based on the best comparisons in each syntax a likelihood probability ratio is computed and compared against a selected threshold for determining whether the speech contains a valid phrase or keyword as compared to an undesirable utterance.

2 Claims, 2 Drawing Sheets

METHOD AND APPARATUS OF REJECTING FALSE HYPOTHESES IN AUTOMATIC SPEECH RECOGNIZER SYSTEMS

The government has rights in this invention pursuant to contract No. MDA-904-83-C-0475 awarded by the Maryland Procurement Office.

This invention relates to a method of rejecting false hypotheses in an automatic speech recognizer system and more particularly to a method and apparatus for performing utterance rejection in such systems employing a likelihood scoring technique.

BACKGROUND OF THE INVENTION

Current automatic speech recognition (ASR) systems are divided basically into two general functional categories. The first category is designated as connected speech recognition (CSR) systems and the second category is word spotting systems. The function of a CSR system is to determine which of a closed set of valid phrases has been spoken, assuming that the input speech is one of these phrases. Word spotting systems, on the other hand, assume the input signal to be a sequence of random sounds interspersed with occasional vocabulary words or keywords. A word spotter detects the occurrence of these keywords.

The recognition methods currently employed in CSR and word spotting systems frequently cause word or phrase utterances to be reported when they are not actually spoken. In the prior art there essentially are two main methods of word spotting. A first method is referred to as keyword scoring (KS) method. The principle of this method was developed and described in 1973 by J. F. Bridle in an article entitled An Efficient Elastic-Template Method for Detecting Given Words in Running Speech published by the British Accoustical Society in the spring meeting, pages 1–4, April 1973. That article is incorporated herein by reference and discusses the derivation of elastic templates from a parameter representation of spoken example of the keywords to be detected.

Briefly, keyword templates are "dragged across" the input speech producing match scores at every input frame. Each match score measures the distance or dissimiliarity between the keyword template and the input speech ending at that frame. The keyword with the lowest match score is hypothesized as having been spoken. The hypothesis is accepted or rejected by comparing the match score with the threshold value. The accuracy of the KS method is improved by a technique called "bias removal" which makes the threshold value a function of the keyword and the speaker.

The second technique can generally be defined as the CSR method because it is implemented using a modified CSR algorithm. This method is described in U.S. patent application Ser. No. 655,958, filed on Sept. 28, 1984 and entitled "Keyword Recognition System and Method Using Template-Concatenation Model" filed for A. L. Higgins et al 1-1-1 and assigned to the assignee herein. In that application there is described a CSR method which uses both "keyword templates" and "filler templates". The technique finds the concatenation or string of templates that most closely matches the incoming speech without making any distinction between "keyword templates" and "filler templates". The system then serves to report the occurrence of a keyword whenever the template for that keyword appears in the best matching template string. The modification to the CSR algorithm involves a concatenation penalty that biases the system in favor of longer templates or "keyword templates". Essentially, that system employs a method that detects the occurrence of keywords in continuously spoken speech and evaluates both the keyword hypothesis and the alternative hypothesis that the observed speech is not a keyword.

A general language model is used to evaluate the latter hypothesis. Arbitrary utterances of the language according to the model described in the application are approximated by concatenations of a set of filler templates. The system allows for automatic detection of the occurrence of keywords in unrestricted natural speech. The systemm can be trained by a particular speaker or can function independently of the speaker.

In regard to the above-described techniques the primary disadvantage of the KS method is that it only uses templates for the keywords. Thus it views all speech from the perspective of keyword templates. The human being on the other hand correctly classifies highly distorted or atypical speech, evidently using models of other speech sounds to tell whether an unknown that is far from the target sound is actually moved closer to other sounds. Because of this limitation, the KS method is highly sensitive to channel conditions, noise and the speaker's voice. In any event, the CSR method briefly described above takes a step towards alleviating this problem by using filler templates, which are intended to model all speech sounds. For a keyword to appear in the best matching template string as to enable it to be detected and reported, incoming speech must be closer to the keyword template than to any concatenation of filler templates.

Thus keyword matches are judged in relation to matches to other speech sounds. The main shortcoming of the CSR method is that it does not treat keyword templates separately from filler templates in the matching process. In terms of hypothesis testing, it does not explicitly separate the keyword hypothesis from the null hypothesis. A specific problem therefore is that keyword matches are not compared with filler template matches over exactly the same intervals. This diminishes the statistical power and therefore the performance of the method. The second shortcoming is that the method does not allow the operating point or tradeoff between false acceptance and false rejection errors to be controlled separately for each keyword.

It is therefore an object of the present invention to provide an apparatus and a method which maintain the distinction between keyword templates and filler templates in both the matching and decision procedures.

It is a further object to provide a system and method which compares keyword matches with filler matches over exactly the same intervals of the input speech thus eliminating the above-noted problems associated with prior art devices.

It is a further object of the present invention to provide separate parametric control of the operating point for each keyword thus providing greater accuracy and control of an automatic speech recognition system.

BRIEF DESCRIPTION OF THE PREFERRED EMBODIMENT

In a method of detecting keywords in continuously spoken speech which method employs keyword templates for evaluating actual spoken keyword matches in an incoming speech signal and filler templates which evaluate arbitrary utterances to guard against processing of such utterances as keywords, the improvement in combination therewith comprising the steps of comparing keyword template matches with filler template matches over the same time intervals of incoming speech signals, computing a likelihood ratio based on said comparison after said interval determinative of said incoming speech being a valid word or an utterance.

DETAILED DESCRIPTION OF THE FIGURES

Figure 1:
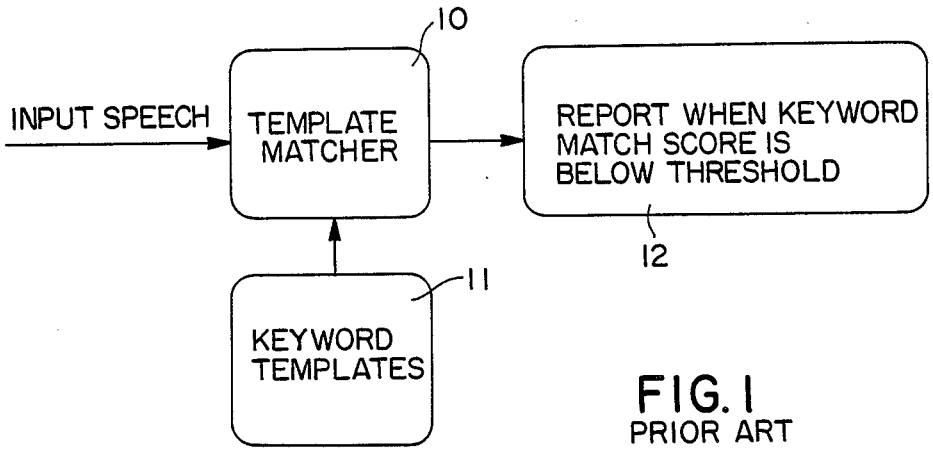
FIG. 1 PRIOR ART
FIG. 1 is a block diagram of a key word scoring method and apparatus according to the prior art.

Referring to FIG. 1, there is shown a simple block diagram depicting a keyword scoring (KS) method according to the prior art. Essentially, input speech is applied to the input of a template matcher 10. The template matcher has another input which is coupled to a plurality of keyword templates 11. The template matcher 10 operates to match the incoming speech with each of the keyword templates 11 and to produce an output when the keyword match score is below a given threshold as determined for example by the circuitry associated with the template matcher and indicated by module 12.

As indicated above, keyword templates are essentially dragged across the input speech and provide match scores at every input speech frame. Each match score measures the distance or dissimilarity between the keyword template and the input speech ending at a particular frame. Thus the keyword with the lowest match score is hypothesized as having been the spoken word. This hypothesis is accepted or rejected by comparing the match score with a given threshold value as evidenced by module 12 of FIG. 1.

As indicated, the accuracy of the KS method is improved by a technique called bias removal which makes the threshold value a function of the keyword and the speaker.

Figure 2:
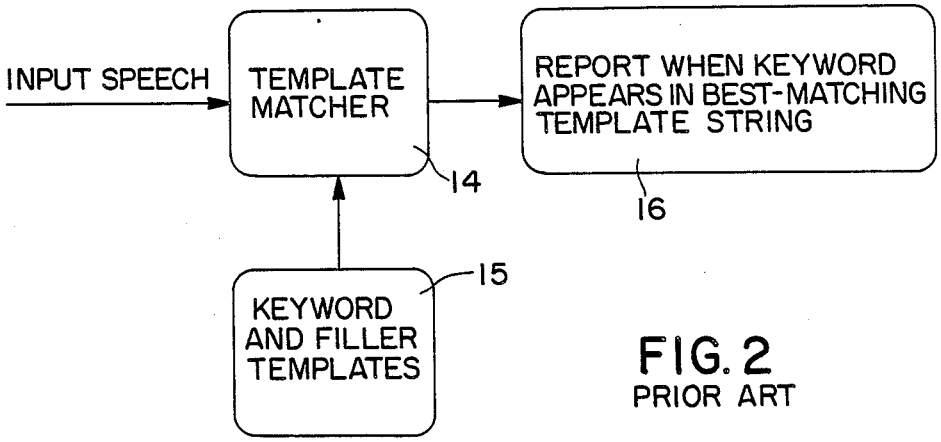
FIG. 2 PRIOR ART
FIG. 2 is a block diagram of a connected speech recognition method and apparatus according to the prior art.

Referring to FIG. 2, there is shown a simple block diagram of a continuous or connected speech recognition (CSR) system. As shown in FIG. 2, input speech is again applied to a template matcher 14. The template matcher 14 operates in conjunction with keyword and filler templates designated as module 15. An output is provided when the keyword appears in the best matching template string as evidenced by module 16 of FIG. 2. Essentially, as indicated, this method is fully described in U.S. patent application entitled "Keyword Recognition System and Method Using Template Concatenation Model" filed on Sept. 28, 1984 as Ser. No. 655,958, as indicated above.

The CSR method uses both the keyword templates and filler templates. It operates to find the concatenation of a string of templates that most closely matches the incoming speech without making any distinction between keyword templates and filler templates. It then operates to report the occurrence of a keyword whenever the template for that keyword appears in the best matching template string. The modification to the CSR algorithm involves a concatenation penalty that biases the system in favor of longer keyword templates. As indicated, both system have problems associated therewith.

In any event, while the block diagrams of FIGS. 1 and 2 are relatively simple, it is also indicated that the technique for performing template matching as well as for keyword templates or filler templates and for deriving the same are well known in the prior art. In view of this the following applications are referred to and deemed to be fully incorporated herein by reference: U.S. Ser. No. 439,018 filed on Nov. 3, 1982 for G. Vensko et al 2-1-1-1 is entitled "A Data Processing Apparatus and Method for Use in Speaker Recognition". That application describes a processing system for particularly operating with incoming speech and for processing the speech and comparing the same by the use of templates. The application describes a plurality of processors each having a shared memory associated therewith and each for performing local processing tasks on data stored in the associated shared memory. There is shown a data transfer means associated with each processor and memory for transferring and redistributing a portion of the data stored in shared memories among the shared memories by distributed direct memory access during and without interfering with local processing of the remaining data stored in the shared memories. The data transfer means includes a shared data bus for transferring data from the shared memory to the remote bus and for transferring data from the shared memory to the local processor for local processing.

The data transfer further includes a plurality of circuits connected to the shared data bus for effecting the data transfer across the shared data bus. Included in the plurality of circuits are interrupt circuits, programmable I/O circuits, direct memory access circuits which are instructed through programmed I/O inputs and a shared controller for controlling access to the shared data bus by one of the plurality of circuits.

A remote controller controls transfer of data across the remote bus. The shared controller includes synchronization circuitry for synchronizing shared data bus requests with the timing of the local processor and priority circuitry to insure that the local processor always has access to the shared memory through the shared data bus without waiting. The processor is used in a continuous speech recognition system where a front end processor is employed for converting digital spectral speech data to frames of parametric data suitable for further speech processing. There is at least two template processors which are employed to store recognizable vocabulary as templates and for comparing the frames of parametric data individually with the stored templates and a master processor is employed to transfer new frames of parametric data to the template processors and to redistribute templates among the template processors for more efficient processing in response to analysis of the results of template comparisons.

Parametric template and results data are transferred by direct memory access in response to control of the DMA circuits by the master processor. As one can ascertain from this application, the processing techniques for operating on templates are well known in the prior art and these techniques as well as the apparatus can be employed in implementing this invention. It is therefore believed that the exact structure for implementing the invention to be described is well known in regard to prior art techniques and hence this application will be confined to the method of implementing the technique according to this invention.

Further reference is made to U.S. patent application Ser. No. 473,422 filed on Mar. 9, 1983 for G. Vensko et al 3-2-2-2 and entitled "Apparatus and Method for Automatic Speech Recognition" and assigned to the assignee herein. That application also refers to an apparatus and method for recognition of speech sentences comprised of utterances which are separated by short pauses. The utterances are representative of both isolated words and connected words. Speech to be recognized is converted into frames of digital signals. Selected ones of the frames of digital signals are compared with isolated word and connected word templates stored in the template memory.

Recognition of isolated words is done by comparing the selected frames of digital signals with the isolated word templates in accordance with a windowed dynamic programming algorithm having path boundary control, while connected word recognition is accomplished by comparing selected frames of digital signals with the connected word templates in accordance with a full DPA having path score normalization and utterance frame penalty calculation capability. Variable frame rate and coding is used to identify the selected frames of digital signals. Syntax control includes selecting the isolated word and connected word templates to be compared after each utterance and includes combining the recognized isolated words and connected words into sentences in accordance with predefined syntax after the end of the sentence has been detected. A logical set of connected words are the connected digits.

This application also shows detailed programming as well as apparatus for providing the above-noted procedures. It is indicated that such apparatus can be employed in conjunction with this invention.

U.S. Pat. No. 4,241,329 issued on Dec. 23, 1980 to L. G. Bahler et al and entitled "Continuous Speech Recognition Method for Improving False Alarm Rates" also describes a system which is pertinent in enabling one to appreciate prior art speech recognition techniques. In that patent a speech recognition method of detecting and recognizing one or more keywords in the continuous audio signal is disclosed. Each keyword is represented by a keyword template which represents one or more target patterns and each target pattern comprises statistics of at least one spectrum selected from plural short term spectra generated according to a predetermined system for processing of the incoming audio. The incoming audio spectra are compared with the target patterns of the keyword templates and candidate keywords are selected according to a predetermined decision process.

In post decision processing, concatenatio techniques based on a likelihood ratio for rejecting false alarms are also disclosed. Post decision processing can include also a prosodic test to enhance the effectiveness of the recognition apparatus. Thus the prior art as indicated is replate with many systems for utilizing both keyword templates and filler templates in automatic speech recognition systems. As indicated, the prior art suffers from many disadvantages which have been described briefly in the Background of the Invention and such disadvantages are also inherent with the methods described in the above-noted systems.

In any event, the apparatus for performing keyword template or filler template matching are known in the prior art and such techniques are evident by structure and apparatus described in the above-noted references.

Figure 3:
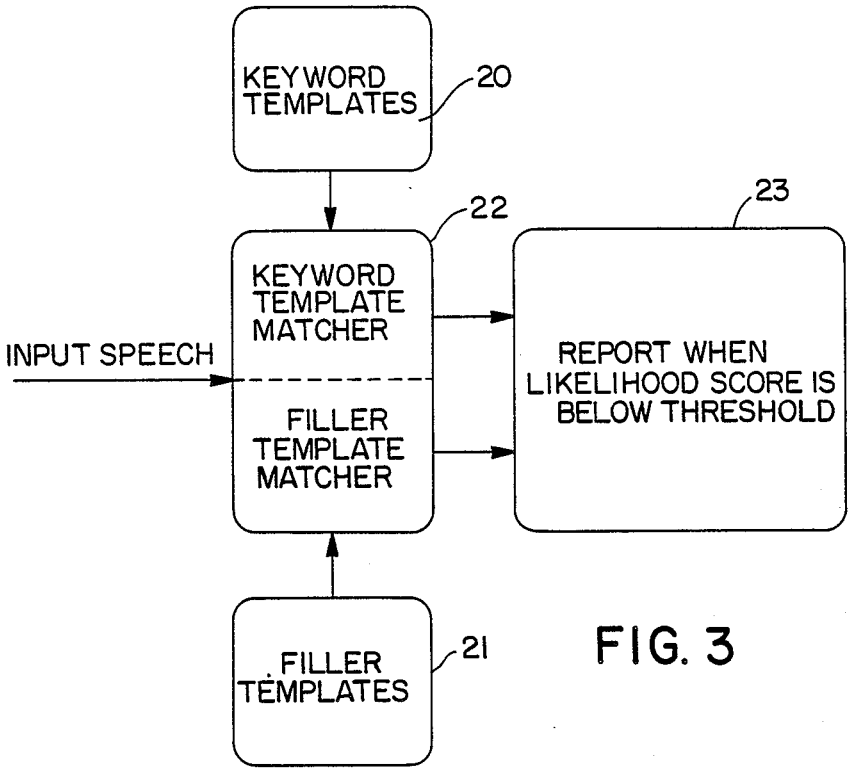
FIG. 3 is a block diagram of the method and apparatus according to this invention.

Referring to FIG. 3, there is shown a block diagram of the method employed according to this invention. Similar to the CSR method, the technique as shown in FIG. 3 utilizes filler templates 21 to normalize keyword match scores. The technique therefore eliminates the disadvantages of the above-described KS method. According to this technique, the method maintains the distinction between keyword templates and filler templates in both the matching and decision procedures. The system compares keyword matches with filler matches over exactly the same intervals of the input speech.

In addition, it allows separate parametric control of the operating point for each keyword. Thus this method is a significant improvement over the prior art CSR techniques as for example shown in the above-noted references.

Referring to FIG. 3, as one can understand, input speech is applied to a combination keyword template matcher and a filler template matcher 22. Essentially, the keyword template matcher is associated with only keyword templates as 20 while the filler template matcher, also contained within module 22, is associated with filler templates 21. An output is provided when a likelihood score is below a given threshold value as is evidenced by module 23 and as will be further explained. It is noted that in regard to FIG. 2, input speech is compared with keyword matches and filler matches over exactly the same intervals of the input speech. This matching occurs in given speech frames for both the keyword templates 20 and filler templates 21. As indicated above, the prior art structure is completely amenable to performing such operation on keyword and filler templates.

The technique as briefly shown in FIG. 3 is based on principles derived from detection theory. As will be explained, the theory is based on the fact that the optimal detector of an event is one that computes the likelihood ratio of the event and performs an accept/reject decision by comparing the likelihood ratio with a threshold. For examples of the theoretical principles involved in regard to the detection theory reference is made to a text entitled *Detection, Estimation and Modulation Theory* by H. L. Van Trees, published by Wiley & Sons, Inc., 1968. The invention applies this principle to the detection or rejection of speech utterances. The likelihood ratio is given by the following equation:

$$LR = \frac{p(I|\text{True})}{p(I|\text{False})}. \qquad \text{(Eq. 1)}$$

where the numerator is the probability, or likelihood, of observing the input signal assuming it is an utterance of interest, while the denominator is the likelihood of observing the input signal in all speech. The invention uses the scores or distances provided by a modified CSR template matcher to approximate these likelihoods. The numerator likelihood is evaluated using whole-word templates for the task vocabulary words, while the denominator likelihood is evaluated using filler templates.

This new method estimates likelihood ratios based on several statistical approximations. First is that individual frames of the input speech are statistically independent of one another. As a consequence, the likelihood functions in Equation 1 can be computed as products of likelihoods of the individual frames that make up the segment of the input signal being tested. Second, the distance between an input spectral frame and a template frame is approximately the negatively scaled logarithm of the likelihood. That is $d=-k*\log(p)$, or equivalently, $p=\exp(-d/k)$, where d and p are distances and liklihoods, respectively, of individual frames. Applying these approximations leads to the following expression for the "likelihood score", or negatively scaled log likelihood ratio for a segment of input speech:

$$-k*\log(LR) = \text{Dist}(I,\text{keyword}) - k*\log\left[\frac{1}{T}\sum_{i=1}^{T}\exp(-\text{Dist}(I,\text{filler}(i))/k)\right] \quad \text{(Eq. 2)}$$

where Dist (I,keyword) is the distance between the segment of speech under consideration and a keyword template, and Dist(I,filler(i)) is the average distance between the same input segment and concatenations of the ith filler template. T is the number of filler templates, and K is a constant that de-weights distances to account for intra-frame correlation of parameters.

Equation 2 expresses the log likelihood ratio in terms of distances or template match scores. Dist(I, keyword) is the sum of individual frame distances, d, between the frames in the segment of interest and corresponding frames of a keyword template. Keyword match scores are provided by a standard CSR template matcher. The summation term on the right-hand side of Equation 2 is computed using a modified CSR template-matching algorithm that performs a computation called "summing of probabilities".

The preferred embodiment of the system is obtained by modifying a CSR system such that disclosed in copending U.S. applications Ser. No. 439,018 filed Nov. 3, 1982 of Vensko, et al, and Ser. No. 473,422 filed Nov. 9, 1983 of Vensko, et al both described above. Hereafter, this system is referred to as the "standard CSR system". The preferred embodiment of the invention differs from the standard CSR system in three respects. First, it uses a syntax structure that divides the templates into two groups-filler templates and templates associated with the task vocabulary. Second, the template matching procedure for matching the filler templates to incoming speech is modified to perform summing of probabilities. Finally, the scoring procedure is modified to compute the likelihood ratio.

To describe the invention, some terminology must be defined.

A CSR system uses a syntax to specify which sequences of templates can be matched to the input speech. A syntax can be thought of as a network containing nodes and directional connections between nodes. Each node has one or more template names. A valid template sequence is obtained by following connections through the network and picking one (any) template each time a node is entered.

A "top score" is obtained at each input frame for each template that is the accumulated distance between the input speech up to and including the current frame and the best concatenation of templates ending at the last frame of that template. To compute the mininum accumulated distance, the dynamic program uses the lowest top score of an input frame as the "bottom score" for the next frame. The other top scores are discarded. All templates starting at the next input frame use the same bottom score. A "global mininum" score is obtained at each input frame that is the minimum accumulated distance between the input speech up to and including the current frame and the best concatenation of templates ending at any template frame.

Figure 4:
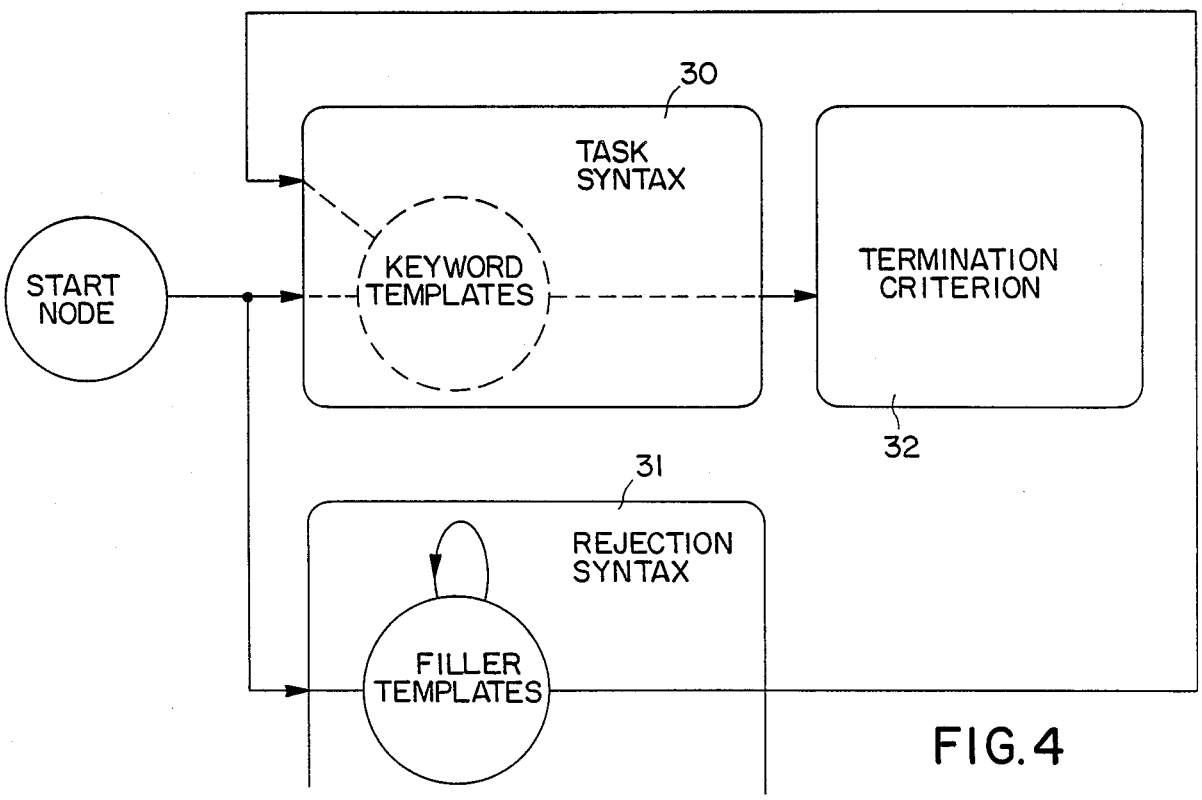
FIG. 4 is a simplified block diagram of a syntax format according to this invention.

The syntax used in the invention is shown in FIG. 4. It is divided into two parts, called a task syntax 30 and a rejection syntax 31. These correpond to the upper and lower halves of the template-matcher shown in FIG. 3. Separate top scores, bottom scores, and global minimum scores are maintained for the two syntaxes. The task syntax 30 may be simple or complex. In the case of wordspotting, the task syntax 30 is a single node containing all the keyword templates, as shown by the dotted lines. The box 32 to the right of the task syntax is called the termination criterion. In an application such as phrase rejection, the termination criterion augments the task syntax with a self-looping silence template. This causes the ASR system to wait for an interval of silence before scoring the phrase. In the wordspotting application, the termination criterion requires no additional processing, as indicated by the dotted line. The combined task syntax and termination criterion is therefore equivalent to a self-looping node in this case. The rejection syntax is a self-looping node containing the filler templates. Keyword and filler templates are matched simultaneously.

The reason for showing the termination criterion in the upper part of the syntax is that the algorithm keeps track of the instants of time at which the task syntax is entered and exited. Likelihood ratios are computed for the incoming speech during the intervening intervals to test the hypothesis that the utterance of interest was spoken.

Algorithmically, summing probabilities is achieved with only slightly greater complexity than the standard CSR matcher. Summing the probabilities uses all the top scores for an input frame to compute the summation term in Equation 2, which serves as the bottom score for the next input frame. The added complexity is associated with the required division and exponentiation operations. The technique uses a method for reducing the complexity by computing the summation term in Equation 2 recursively using table lookups. Each step of the recursion uses the following equation:

$$\text{SUM}_i=\min(\text{SUM}_{i-1},D_i)-k*\log(1.0+\exp(-|\text{SUM}_{i-1}-D_i|/k)) \quad \text{(Eq. 3)}$$

where $\text{SUM}_i$ is the distance equivalent to the sum of probabilities including i terms. The recursion is initialized at each input frame by setting $\text{SUM}_o=D_o$ where $D_i$ is the top score to the ith template. The log term in Equation 3 is looked up in a table.

The invention computes the likelihood score of Equation 2 for every hypothesized utterance. In the case of wordspotting, a keyword is hypothesized to have ended at every frame of input speech. The likelihood computation then proceeds as follows:

At each input frame, N:

1. Find which keyword template has the lowest top score.

2. Trace back to determine when the match to that keyword template started (frame M).

3. $S_K$=(lowest keyword top score at frame N−keyword bottom score at frame M)

4. $S_F$=(filler global minimum at frame N−filler global minimum at frame (M)

5. If $S_K - S_F$<keyword threshold, report valid match.

As with other detection/rejection methods, thresholds are determined empirically to achieve the desired operating point.

The best method for generating filler templates for wordspotting is to simply "chop" the keyword template set into 100 millisecond pieces. Using this method, keywords and keyword pieces share parameters, and score normalization deals with distances in the same space.

Equation 2 does not apply uniquely to the wordspotting application. It applies to the general problem of testing a given interval of speech to determine whether it contains an utterance of interest. The method is applied to CSR, with a given task vocabulary and syntax, as follows. An existing CSR system such as those referenced above is used in place of the "Keyword Template Matcher" shown in FIG. 3. The task vocabulary replaces the "Keyword Templates". The given task syntax is inserted in the "Task Syntax" block in FIG. 4. The termination criterion adds a single self-looping node containing a silence template of about 250 ms duration.

Whenever the global minimum is found in this silence template, the best matching path is traced back to find the beginning and ending of the matched phrase. The likelihood score is then computed as described above.

What is claimed is:

1. A method of improving the reliability of keyword identification by a speech recognition system for continuously spoken speech in a given language comprising the steps of:

providing a set of keyword templates each of which represents a respective keyword for recognition by said system;

providing a set of filler templates each of which is representative of an arbitrary sound or utterance that is a component of spoken speech including words in said given language;

generating a set of signals indicative of said spoken speech in a given time interval;

providing parallel operations of:

(a) comparing said set of signals with said keyword templates and selecting the keyword template having the greatest statistical similarity to said set of signals in said given time interval; and generating a keyword match score indicative of the statistical distance of said selected keyword template from said set of signals; and (b) separately comparing said set of signals with said filler templates and selecting a concatenation of filler templates having the greatest statistical similarity to said set of signals in the same given time interval; and generating a filler concatenation match score indicative of the statistical distance of said conctenation of filler templates from said set of signals; and comparing the keyword match score to the filler concatenation match score to determine, according to a pre-established threshold, whether said keyword match score is sufficiently better than said filler concatenation match score to confirm keyword identification.

2. A method of detecting keywords in continuously spoken speech comprising:

generating a series of speech samples from said spoken speech for a given time interval;

comparing said samples in said given time interval to a set of keyword templates each of which represents a respective keyword and selecting one of said keyword templates as a best keyword match for said speech samples;

generating a keyword match score indicative of the degree of matching of said samples in said given time interval to said selected keyword template;

separately comparing said samples to a set of filler templates, each filler template corresponding to an arbitrary sound or utterance that is a component of spoken speech including words, and selecting a concatenation of said filler templates as a best filler concatenation match for said samples in the same given time interval;

generating a filler concatenation match score indicative of the degree of matching of said samples in said given time interval to said filler concatenation; and comparing said keyword match score to said filler concatenation match score to confirm that said keyword match score exceeds said filler concatenation match score by a predetermined threshold to confirm keyword detection.

* * * * *